US007101212B1

(12) United States Patent
Larkin

(10) Patent No.: US 7,101,212 B1
(45) Date of Patent: Sep. 5, 2006

(54) SNAGLESS PLUG AND BOOT CONNECTION

(76) Inventor: Kevin Larkin, P.O. Box 1538, Pebble Beach, CA (US) 93953

( * ) Notice: Subject to any disclaimer, the term of this patent is extended or adjusted under 35 U.S.C. 154(b) by 0 days.

(21) Appl. No.: 11/073,988

(22) Filed: Mar. 7, 2005

(51) Int. Cl.
*H01R 13/625* (2006.01)

(52) U.S. Cl. ..... 439/344

(58) Field of Classification Search ..... 439/344–347
See application file for complete search history.

(56) References Cited

U.S. PATENT DOCUMENTS

| | | | | |
|---|---|---|---|---|
| 5,334,044 | A | 8/1994 | Falossi et al. | 439/491 |
| 5,462,457 | A | 10/1995 | Schroepfer et al. | 439/736 |
| 5,494,457 | A | 2/1996 | Kunz | 439/447 |
| 5,538,438 | A | 7/1996 | Orlando | 439/344 |
| 5,562,475 | A | 10/1996 | Kern, Jr. et al. | 439/344 |
| 5,600,885 | A | 2/1997 | Schroepfer et al. | 29/883 |
| 5,620,335 | A | 4/1997 | Siemon | 439/491 |
| 5,638,474 | A * | 6/1997 | Lampert et al. | 385/78 |
| 5,685,736 | A | 11/1997 | Lung | 439/447 |
| 5,727,962 | A * | 3/1998 | Caveney et al. | 439/344 |
| D402,266 | S | 12/1998 | Siemon et al. | D13/156 |
| 5,893,771 | A | 4/1999 | Kern, Jr. et al. | 439/344 |
| 5,993,237 | A | 11/1999 | Kern, Jr. et al. | 439/344 |
| D420,329 | S | 2/2000 | Lin et al. | D13/147 |
| 6,080,001 | A | 6/2000 | Wong | 439/344 |
| 6,174,190 | B1 * | 1/2001 | Tharp et al. | 439/352 |
| 6,196,733 | B1 * | 3/2001 | Wild | 385/86 |
| 6,210,200 | B1 | 4/2001 | Kranzdorf | 439/344 |
| 6,250,817 | B1 * | 6/2001 | Lampert et al. | 385/56 |
| 6,250,949 | B1 * | 6/2001 | Lin | 439/418 |
| 6,322,386 | B1 | 11/2001 | Tharp et al. | 439/344 |
| D466,479 | S * | 12/2002 | Pein et al. | D13/147 |
| 2005/0054230 | A1 * | 3/2005 | Huang | 439/344 |

* cited by examiner

*Primary Examiner*—Ross Gushi
*Assistant Examiner*—Larisa Tsukerman
(74) *Attorney, Agent, or Firm*—Stallman & Pollock LLP

(57) ABSTRACT

A boot with a flexible actuator can be used to provide improved protection and ease of use for an electrical connector plug. The plug, such as an RJ45 plug connected to a data or communications cable, can have an extended latch member adapted to releasably engage a connection mechanism of a receptacle into which the plug is placed. A receiving portion of the actuator can engage the extended end of the latch member, whereby damage to the latch member due to snagging or catching on nearby objects is prevented. The actuator also functions as an extension of the latch mechanism, providing additional area for a user to depress the latch in order to remove the plug from the receptacle. The actuator can have a substantially smooth shape that prevents the actuator from catching on surrounding objects.

11 Claims, 4 Drawing Sheets

SNAGLESS PLUG AND BOOT CONNECTION

TECHNICAL FIELD OF THE INVENTION

The present invention relates to electrical connections and cable assemblies useful in telecommunications and data transfer applications.

BACKGROUND

When making an electrical connection for a communications cable, a plug 100 attached to an end of the cable 102 as shown in FIG. 1 is shaped to be received by, and held in, an appropriate receptacle in order to establish the connection. The plug typically has a main body portion 104 that is at least partially received by the receptacle (not shown). The plug typically also has a resiliently flexible latch member 106 extending from the main body portion 104. The latch 106 extends at an angle relative to the body, such that as the plug is inserted into the receptacle, the extended end of the latch is forced toward the main body portion. The latch typically is thinner at the extended end than at the end connected to the main body portion, such that when the plug 100 is inserted a proper distance into the receptacle, the thin portion of the latch member 106 can fit through a recess area in the receptacle such that the latch member can "snap" into place as the extended end of the latch member springs away from the main body portion 104. The recess in the receptacle is shaped in such a way that the thicker portion of the latch member cannot pass back through the recess once the latch is snapped in place, thereby holding the plug in place within the receptacle. Mechanisms and recesses for providing this latch/receptacle connection are well known in the art and are not described in detail herein. The extended end of the latch member extends a distance outside the receptacle such that a user can dislodge the plug from the receptacle by "squeezing" the extended end of the latch toward the main body portion, whereby the thicker end of the latch is pushed away from, and/or out of, the recess area and the plug can be removed from the receptacle. This connection approach is commonly used for telephones and telephone cords, as well as for computers and data cables, such as those which adhere to the RJ45 standard as known in the art.

One problem with such a latch member, which typically is a thin piece of plastic attached to the main body portion, is that the latch member can easily be snapped off the main body portion. For example, it may be necessary when running a communications cable to pull the cord through a wall or behind office furniture. It is not uncommon for the latch member to "snag" or catch on an object or obstruction during such a pull, whereby the latch member can be broken from the plug.

A number of approaches have been taken to prevent damage to the latch member. In one approach, the main body 104 of the plug is formed with peaks or wing members 108 as shown in FIG. 1 that extend at least as far as the latch member 106. These peaks then will prevent the vast majority of these obstructions from engaging and/or damaging the latch member. While this approach may be acceptable for new runs of cable, it cannot easily be used to upgrade or retrofit existing runs as it is necessary to replace the housing of each plug with a housing that includes the wing members.

In another, more common approach a "boot" 208 or overmold housing is provided that extends over a portion of the communications cable 202, or is part of the exterior of the communications cable, further extending over a portion of the main body 204 and latch member 206 of the plug 200, as shown in FIG. 2. A boot 208 can provide strain relief for the plug/cable connection, and can insulate the electrical connection, as known in the art. The interior of a boot, or at least that portion of the boot that contacts the cable, can adhere to an external surface of the cable, preferably without any air pockets, surface features, or voids that can lessen the strength of the connection. The boot can be made of a plastic, rubber, or polymer material, typically having a rounded, flexible hood portion 210 covering the extended end of the latch member 206 such that the extended end is prevented from snagging on any obstructions. In order for the hood portion to sufficiently protect the latch member, however, it is necessary for the hood material to be relatively rigid in order to provide a certain strength of protection. This rigidity, however, can make it somewhat difficult for a user to squeeze the hood portion 210 in order to depress the latch member 206 and release the plug 200 from the receptacle (not shown).

In yet another approach, a boot is used that does not include a hood portion as in FIG. 2, but instead includes extended wing members similar to those described with respect to FIG. 1. This approach allows the wings to be added to any existing plug simply by placing a boot over plug/cable interface. A downside with such an approach, however, is that it can be difficult for a user to sufficiently depress the latch member, as the size of one of the user's fingers is typically larger than the space between the wing members in which the latch member resides.

DETAILED DESCRIPTION

Systems and methods in accordance with embodiments of the present invention can overcome various deficiencies in existing communication connections by providing an improved electrical connector capable of protecting a latching member of the connector while allowing for easy actuation of the latch member by a user.

Figure 1:
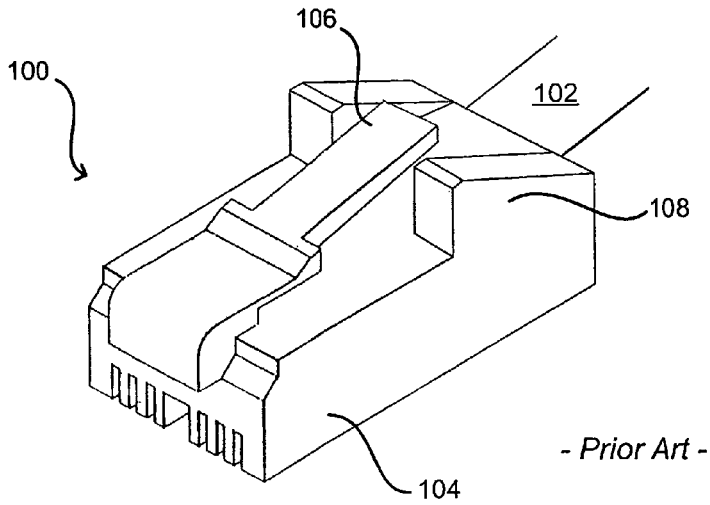
FIG. 1 is a perspective view of a plug connector of the prior art.
Figure 2:
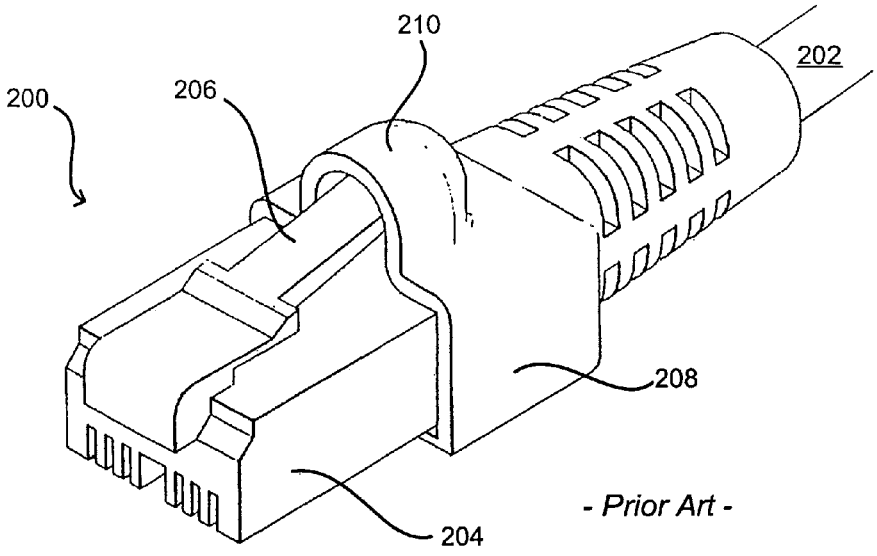
FIG. 2 is a perspective view of a plug connector and boot of the prior art.
Figure 3A:
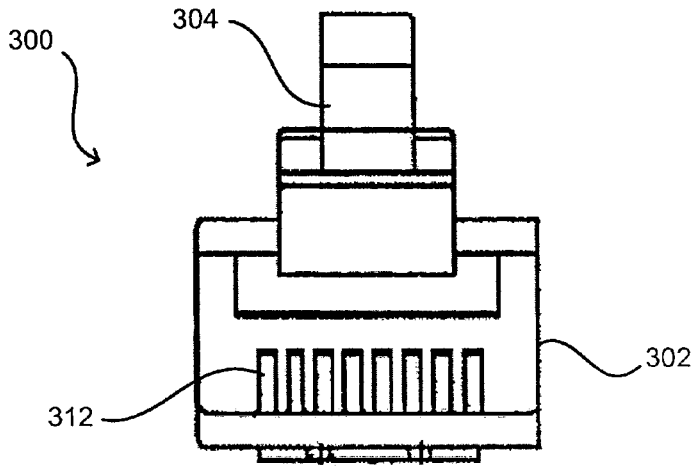
FIG. 3 is (a) and end view and (b) a side view of a plug connector in accordance with one embodiment of the present invention.
Figure 3B:
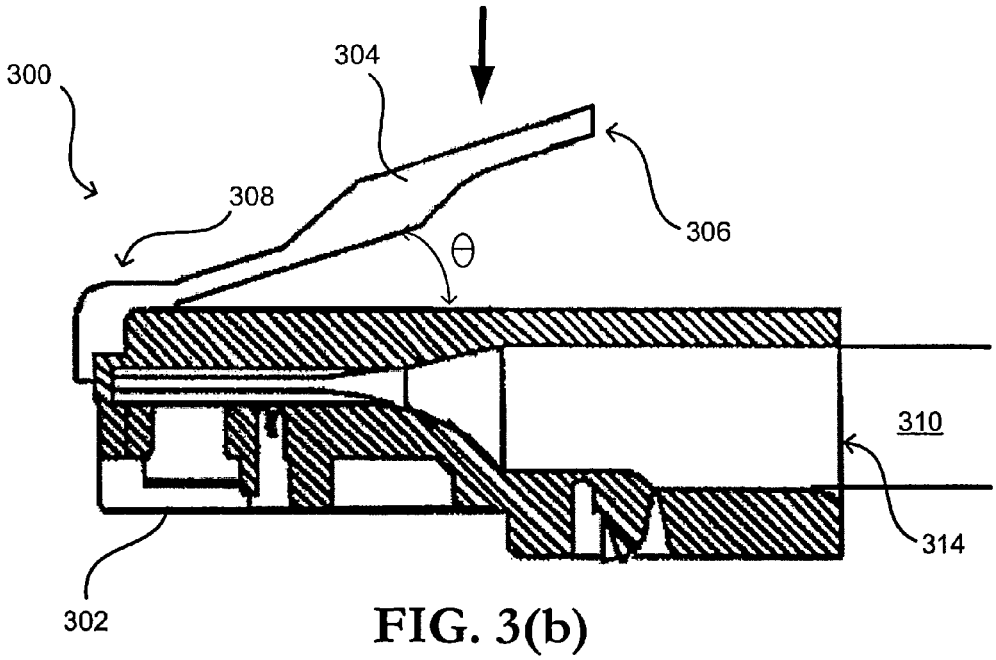

An exemplary electrical connector plug 300 for terminating a communications cable in accordance with one embodiment is shown in FIG. 3. The plug includes a main body portion 302 and an angled, resilient latch member 304. The resilient latch member is attached to the main body portion at a flexure point 308, and has an extended end 306 that extends away from the main body 302. The latch member can be moved upon manual actuation, such as when a user applies a force to the latch member in a direction similar to that indicated by the arrow in FIG. 3(*b*). The latch member can be integral with the body portion, and can be fabricated from any suitable material such as a substantially rigid plastic. It should be understood that the latch member can be a portion of the molded plug, of sufficient thickness at the flexure point to allow for a flexing of the extended end of the latch member toward the main body portion, and not a separately created piece. The latch member 304 can be shaped to have a thinner extended portion, such as described above, to releasably connect the plug 300 to an appropriate connecting member in a receptacle (not shown) when the plug is sufficiently pressed into the receptacle. The resiliently flexible design of the latch member also can allow the latch member to be biased to an initial angular position 0 relative to the plug body 302, such that the latch member 304 tends to spring back to that initial position upon removal of the plug from the receptacle, as well as upon proper connection placement of the plug relative to the receptacle, whereby the latch member can snap into place relative to the connection member of the receptacle to hold the plug in place until subsequent disengagement by a user.

The main body 302 has an opening 314 at a first end for receiving a portion of a communications cable 310 or cord, or at least the wires or other communication means therein. The opening can be large enough to accept the cable 310 and any insulation or outer layer of the cable. The main body also has at least one opening 312 at a second end, namely the operable end of the plug that will be received by an appropriate receptacle. An appropriate receptacle will have a cavity therein for receiving at least a portion of the plug at the operable end. The opening(s) at the second end of the plug can be of sufficient dimension to allow each of the individual wires of the communications cable to pass to the operable opening(s), typically in a linear array configuration as known in the art. The exposed ends of the wires then can be connected to, or placed in contact with, corresponding electrical contacts formed in the opening(s) 312 at the operable end of the plug. These electrical contacts can be used to provide electrical connections to the appropriate pads, wires, pins, or contacts of an appropriate communications receptacle.

Figure 4A:
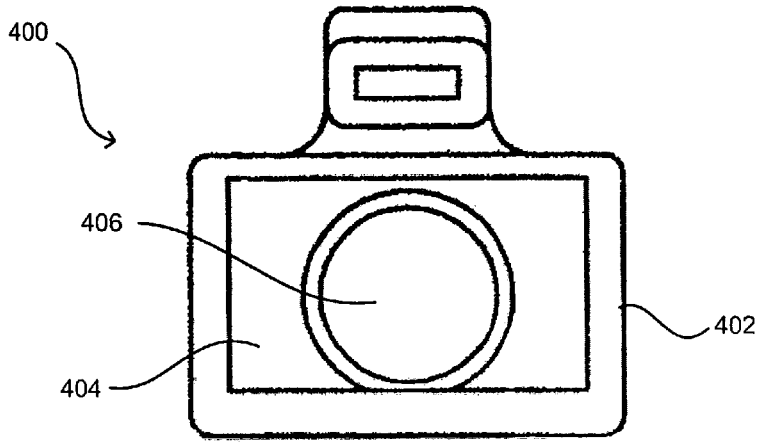
FIG. 4 is (a) an end view and (b) a side view of a boot that can be used with the plug connector of FIG. 3.
Figure 4B:
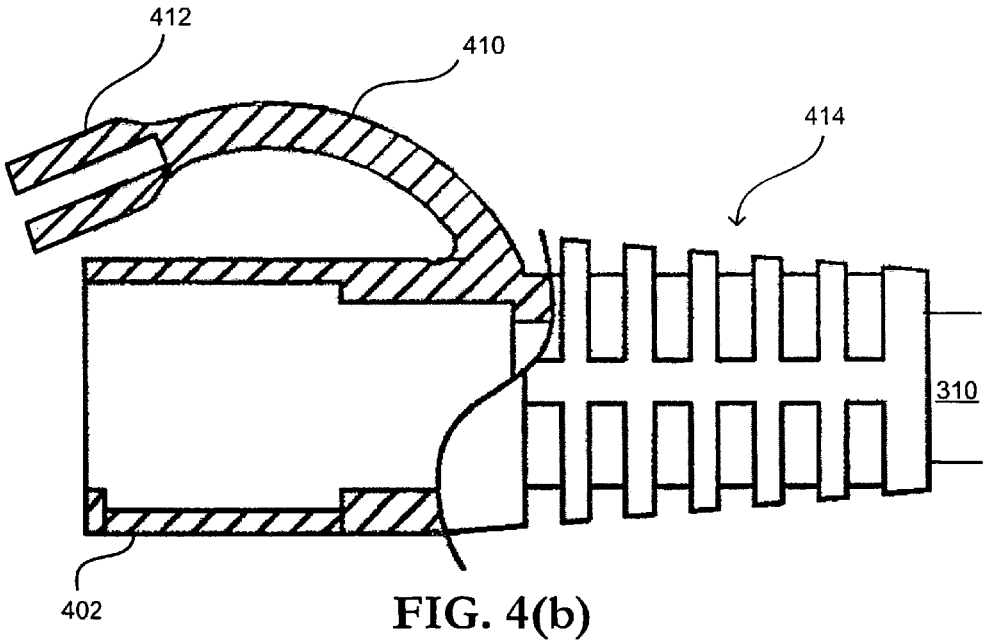

An exemplary boot 400 that can be used with the plug of FIG. 3 in accordance with one embodiment of the present invention is shown in FIG. 4. Reference numbers are carried over between Figures where appropriate, for simplicity. The boot can be made of any appropriate material, such as for example a molded plastic or rubber. In some embodiments, the boot is preferably formed from an insulating material capable of electrically insulating the wires inside the cable and/or plug. The material in one embodiment should be flexible enough to allow proper fitting relative to the plug, while also providing a relatively slip-free grip on the boot. The material also can avoid the presence of air gaps or voids between the plug and the boot where possible, which could otherwise lessen the grip of the boot. The boot includes a housing portion 402, which can have four walls and a back panel 404. The back panel 404 includes an opening 406 of sufficient dimension to allow and end of a communications cable 408, or at least the wires contained therein, to pass through. It can be preferable for the opening 406 to be of approximately the same diameter as the diameter of the cable, in order to provide gripping strength and to prevent contaminants, liquids, or electrical charges from entering the boot. This opening also allows the boot 400 to be placed at least partially over the cable and slid into an operable position against the plug connector 300. The four walls of the housing can form a rectangular opening opposite the back panel 404, of sufficient dimension to allow an appropriate plug to slide into the interior of the boot. In another embodiment, a front panel can be provided which includes the rectangular or other appropriately shaped opening for receiving the plug.

Figure 5A:
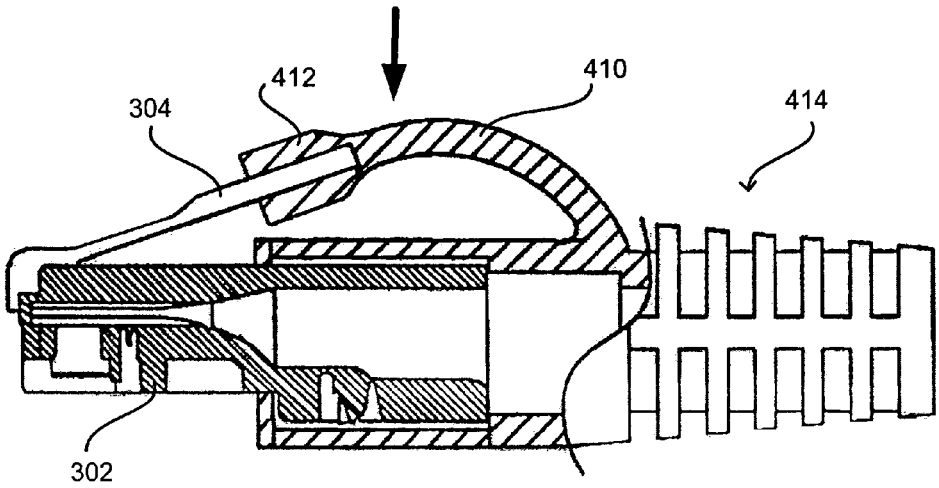
FIG. 5 is (a) a side view and (b) a perspective view of the interconnected plug and boot of FIGS. 3 and 4.
Figure 5B:
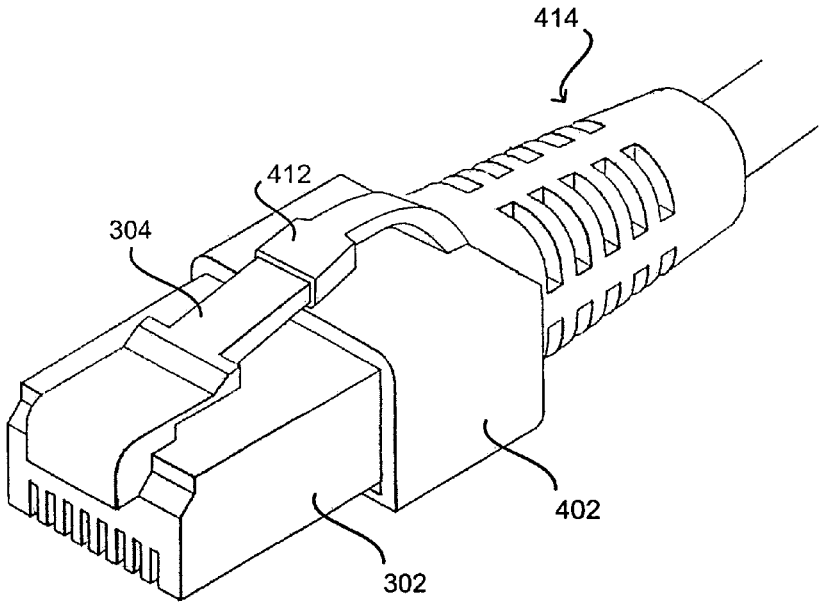

A resiliently flexible, arcuate actuator 410 can be attached to, or molded as part of, the exterior of one of the boot walls. The actuator 410 can have a substantially rounded shape extending away from the boot, or can have any other relatively smooth shape that will resist snagging when brought against an obstruction. The extended end of the actuator 410 can include a receiving portion 412 having an opening shaped to slidably receive the extended end of a latch member for a plug contained at least partially within the plug housing 402. The latch member of the plug also can be shaped to easily be received by the receiving portion. The receiving portion 412 or extended end of the latch member 304 can have a bump or ridge shaped to fit into a groove, recess, or hole of the other member in order to allow the extended end to snap into place when inserted into the receiving portion. The interaction between the extended end of a latch member 304 and the receiving portion 412 of the plug actuator 410 can be seen in FIG. 5. The flexible actuator 410, when the receiving portion 412 has an extended end of a plug latch therein, allows a user to simply squeeze the flexible actuator with respect to the plug body, in a motion similar to that shown by the arrow in FIG. 5, whereby the latch member of the plug can be released from a corresponding receptacle as discussed above. The flexible actuator can be flexible enough to provide an ease of motion for a user, while having sufficient strength to prevent damage to the actuator 410 and/or latch member 304 due to obstructions and/or objects coming into contact therewith. The actuator 410 can be formed of a material that can restore its shape after depression or deflection by a user. A benefit to such an actuator is that the actuator functions as an extension to the latch member, making it easier for a user to depress the latch mechanism in order to remove the plug from the receptacle. The actuator has an advantage over a longer latch mechanism, however, in that the smooth shape and receiving portion of the actuator, in addition to the fact that the actuator provides a connection point at the opposite end of the latch member, prevent the latch member from catching or snagging on surrounding objects. Simply extending the latch member would increase the likelihood of snagging and damage to the latch member.

The boot 400 also can utilize a strain relief component 414 as known and used in the art. The strain relief component can be integral with the boot housing, or can be a separate piece that is brought into contact with, and connected or adhered to, the boot housing and/or the plug connector. The strain relief component can strengthen the connection between the communication cable 310 and the plug connector 300. The component also can allow for a bending of the cable without applying any appreciable bending force to either the plug or the boot. The strain relief component can be any appropriate strain relief component known or used in the art, including a passage to receive the communication cable 310. The strain relief component 414 also can have a number of ribs and/or grooves on the external surface, which can increase the flexibility of the component while maintaining strength and ability to absorb bending forces.

The boot housing 402 can be made of at least two portions in one embodiment, allowing the boot to be attached to the plug and/or cable without having to slip the boot over an end of the cable and/or remove the plug from the cable for retrofit applications. For instance, a boot (which can include an integrated strain relief component and/or actuator) can include a top half and a bottom half that are adhered, bolted, snapped together, screwed together, or otherwise connected to one another once in place relative to at least one of a cable and plug connector.

The boot housing also can be colored, or can have a symbol or description formed therein, which can allow the attached cable to be identified relative to other cables and/or cords positioned around the connector. Appropriate coloration and/or coding also allows the proper connector to easily be placed in the appropriate receptacle.

It should be recognized that a number of variations of the above-identified embodiments will be obvious to one of ordinary skill in the art in view of the foregoing description. Accordingly, the invention is not to be limited by those specific embodiments and methods of the present invention shown and described herein. Rather, the scope of the invention is to be defined by the following claims and their equivalents.

What is claimed is:

1. A connector for a communications cable, comprising:

a plug having a body portion for receiving an end of the communications cable, the plug further having a resilient latch member attached to the outer surface of the body potion, the resilient latch member extending away from the body portion at an angle and having an extended end opposite the body portion; and a boot having a housing portion for receiving the body portion of the plug and the end of the communications cable, the boot further having a flexible arcuate actuator attached to the outer surface of the housing portion, the flexible actuator having a receiving portion at the end opposite the housing portion that has a walled recessed channel shaped to receive and capture the extended end of the resilient latch member when the plug is partially contained within said housing, whereby movement of the flexible actuator toward the housing causes a movement of the resilient latch member toward the body portion of the plug.

2. A connector according to claim 1, wherein:

the resilient latch member is thinner at the extended end than at the end flexibly attached to the body portion, such that the extended end can releasably engage a connection mechanism of a receptacle into which the plug is placed, the receptacle having a cavity for receiving the plug.

3. A connector according to claim 1, wherein:

the flexible actuator has a substantially smooth shape, whereby the flexible actuator will resist catching on any adjacent objects.

4. A connector according to claim 1, wherein:

the boot further contains a strain relief component for preventing any strain on the cable from weakening the connection between the cable and the plug.

5. A connector for terminating a communication cable, comprising:

a plug for receiving the cable through a rear end thereof, a front end of the plug including slots for receiving and supporting one or more wires carried by the communication cable, the plug further including an elongated, resilient latch member having a first end being attached near the front end of the plug and a second end extending upwardly at an angle and towards the rear end of the plug; and a boot having a housing into which a portion of the rear end of the plug is received with the communication cable passing through the housing, the boot further including a resilient arcuate actuator having one end thereof being connected to the housing and the other end including a walled recessed channel for receiving and capturing said second end of the resilient latch member configured such that when the actuator is depressed the latch will also be depressed.

6. A connector according to claim 5, wherein:

the second end of the resilient latch member has a generally rectangular cross section and the slot located at the other end of the arcuate actuator includes a rectangular opening for receiving and securing said second end of the resilient latch member.

7. A boot for a communications connector including a plug connected to a communications cable, the boot comprising:

a housing portion having an first opening for receiving a body portion of a plug and a second end for passing a connected end of the communications cable; and a flexible arcuate actuator flexibly attached to the outer surface of the housing portion, the flexible actuator having a walled recessed channel at an end opposite the housing portion that is shaped to receive and capture an extended end of a resilient latch member of the plug when the plug is partially contained within said housing portion, whereby movement of the flexible actuator toward the housing causes a movement of the resilient latch member toward the body portion of the plug.

8. A boot according to claim 7, wherein:

movement of the flexible actuator toward the housing portion causes the resilient latch member to disengage from a connection mechanism of a receptacle into which the plug has been placed, whereby the plug can be removed from the receptacle.

9. A boot according to claim 7, wherein:

the flexible actuator has a substantially smooth shape, whereby the flexible actuator will resist catching on any adjacent objects.

10. A boot according to claim 7, wherein:

the boot further contains a strain relief component for preventing any strain on the cable from weakening the connection between the cable and the plug.

11. A boot according to claim 7, wherein:

the housing portion contains at least two connectable portions, whereby the housing portion can be placed over the plug and cable without disconnecting the plug from the cable.

* * * * *